US010289047B2

(12) United States Patent
Yamauchi

(10) Patent No.: US 10,289,047 B2
(45) Date of Patent: May 14, 2019

(54) IMAGE FORMING APPARATUS AND NON-TRANSITORY COMPUTER READABLE MEDIUM

(71) Applicant: FUJI XEROX CO., LTD., Tokyo (JP)

(72) Inventor: Shoji Yamauchi, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/810,140

(22) Filed: Nov. 13, 2017

(65) Prior Publication Data

US 2018/0231928 A1 Aug. 16, 2018

(30) Foreign Application Priority Data

Feb. 16, 2017 (JP) ..... 2017-026794

(51) Int. Cl.
*G03G 15/01* (2006.01)
*G03G 15/08* (2006.01)
*G03G 15/00* (2006.01)

(52) U.S. Cl.
CPC ..... *G03G 15/5041* (2013.01); *G03G 15/0184* (2013.01); *G03G 15/0189* (2013.01); *G03G 15/0879* (2013.01); *G03G 15/5058* (2013.01); *G03G 15/5062* (2013.01); *G03G 15/55* (2013.01); *G03G 15/0121* (2013.01)

(58) Field of Classification Search
CPC ..... G03G 15/0121; G03G 15/0184; G03G 15/5041
See application file for complete search history.

(56) References Cited

U.S. PATENT DOCUMENTS

2011/0242551 A1* 10/2011 Furukawa ..... H04N 1/60 358/1.2
2013/0148138 A1* 6/2013 Tanaka ..... H04N 1/04 358/1.9
2015/0362879 A1* 12/2015 Kaneko ..... G03G 15/556 399/49

FOREIGN PATENT DOCUMENTS

JP 2003029478 1/2003
JP 2007292954 11/2007

* cited by examiner

*Primary Examiner* — Gregory H Curran
(74) *Attorney, Agent, or Firm* — JCIPRNET

(57) ABSTRACT

An image forming apparatus includes a developing device that performs a developing process by using two-component developer; an image carrier that carries a toner image including a toner band developed by the developing device; a density detection unit that detects a density of the toner band; and a determining unit that determines whether or not to perform a density adjustment on the basis of the density of the toner band detected by the density detection unit.

11 Claims, 5 Drawing Sheets

IMAGE FORMING APPARATUS AND NON-TRANSITORY COMPUTER READABLE MEDIUM

CROSS-REFERENCE TO RELATED APPLICATIONS

This application is based on and claims priority under 35 USC 119 from Japanese Patent Application No. 2017-026794 filed Feb. 16, 2017.

BACKGROUND

Technical Field

The present invention relates to an image forming apparatus and a non-transitory computer readable medium.

SUMMARY

According to an aspect of the invention, there is provided an image forming apparatus including a developing device that performs a developing process by using two-component developer; an image carrier that carries a toner image including a toner band developed by the developing device; a density detection unit that detects a density of the toner band; and a determining unit that determines whether or not to perform a density adjustment on the basis of the density of the toner band detected by the density detection unit.

BRIEF DESCRIPTION OF THE DRAWINGS

An exemplary embodiment of the present invention will be described in detail based on the following figures, wherein.

DETAILED DESCRIPTION

An exemplary embodiment of the present invention will be described with reference to the accompanying drawings.

Figure 1:
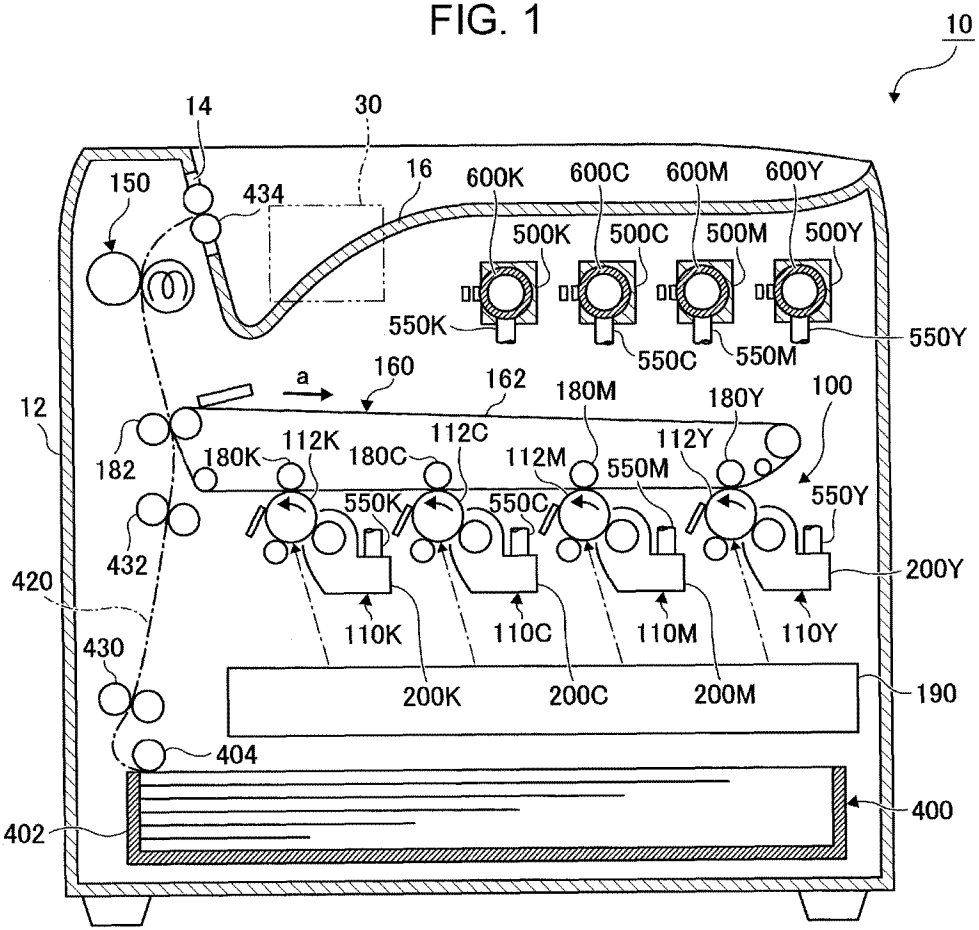
FIG. 1 illustrates an image forming apparatus according to an exemplary embodiment of the present invention.

FIG. 1 illustrates an image forming apparatus 10 according to the exemplary embodiment of the present invention. As illustrated in FIG. 1, the image forming apparatus 10 includes an image forming apparatus body 12. The image forming apparatus body 12 has a discharge opening 14 through which a paper sheet, which serves as a recording medium, is discharged. The top surface of the image forming apparatus body 12 serves as a discharge portion 16 to which the paper sheet is discharged after an image is formed thereon.

Attachment devices 500Y, 500M, 500C, and 500K are disposed in an upper section of the image forming apparatus body 12. Containers 600Y, 600M, 600C, and 600K are respectively attached to the attachment devices 500Y, 500M, 500C, and 500K. The containers 600Y, 600M, 600C, and 600K respectively contain yellow toner, magenta toner, cyan toner, and black toner.

An image forming section 100 is disposed in the image forming apparatus body 12. The image forming section 100 forms an image by using the toners contained in the containers 600Y, 600M, 600C, and 600K. The image forming section 100 includes image forming units 110Y, 110M, 110C, and 110K.

The image forming units 110Y, 110M, 110C, and 110K respectively include photoconductor drums 112Y, 112M, 112C, and 112K and developing devices 200Y, 200M, 200C, and 200K, and respectively form a yellow toner image, a magenta toner image, a cyan toner image, and a black toner image. The detailed structure of the image forming units 110Y, 110M, 110C, and 110K will be described below.

Transport devices 550Y, 550M, 550C, and 550K are also disposed in the image forming apparatus body 12. The transport devices 550Y, 550M, 550C, and 550K respectively transport the toners contained in the containers 600Y, 600M, 600C, and 600K to the developing devices 200Y, 200M, 200C, and 200K.

The image forming section 100 also includes an optical writing device 190. The optical writing device 190 forms latent images on the surfaces of the photoconductor drums 112Y, 112M, 112C, and 112K by irradiating the surfaces with light.

The image forming section 100 also includes a transfer device 160. The transfer device 160 transfers the toner images formed on the photoconductor drums 112Y, 112M, 112C, and 112K to the paper sheet. The transfer device 160 includes an intermediate transfer body 162. The intermediate transfer body 162 is endless-belt-shaped, and is wrapped around plural rollers. The intermediate transfer body 162 rotates in the direction of arrow a in FIG. 1.

The transfer device 160 also includes first transfer members 180Y, 180M, 180C, and 180K. The first transfer members 180Y, 180M, 180C, and 180K respectively transfer the toner images formed on the photoconductor drums 112Y, 112M, 112C, and 112K onto the intermediate transfer body 162.

The transfer device 160 also includes a second transfer member 182. The second transfer member 182 transfers the toner images that have been transferred to the intermediate transfer body 162 onto the paper sheet.

The image forming section 100 also includes a fixing device 150. The fixing device 150 fixes the toner images that have been transferred to the paper sheet by the second transfer member 182 to the paper sheet by, for example, applying heat and pressure.

A sheet feeding device 400 is disposed in a lower section of the image forming apparatus body 12. The sheet feeding device 400 includes a sheet storage unit 402 and a feed roller 404. The sheet storage unit 402 stores a stack of paper sheets. The feed roller 404 picks up the uppermost one of the paper sheets stored in the sheet storage unit 402, and feeds the uppermost paper sheet toward the image forming section 100.

A sheet transport path 420 is formed in the image forming apparatus body 12. The sheet transport path 420 is used to transport the paper sheet fed from the sheet feeding device 400 to the image forming section 100, and to discharge the paper sheet to the outside of the image forming apparatus body 12 after an image is formed thereon. The above-described feed roller 404, a transport roller 430, a registration roller 432, the above-described second transfer device 182, the above-described fixing device 150, and a discharge roller 434 are arranged in the image forming apparatus body 12 along the sheet transport path 420 in that order in the direction in which the paper sheet is transported.

The image forming apparatus 10 also includes a display operating device 30. The display operating device 30 is attached to, for example, an external front surface of the image forming apparatus body 12. The display operating device 30 includes, for example, a touch panel, and is used to display the status of the image forming apparatus 10 and operate the image forming apparatus 10.

In the above-described image forming apparatus 10, the image forming units 110Y, 110M, 1100, and 110K have the same structure. Therefore, the image forming units 110Y, 110M, 110C, and 110K will be generically referred to as image forming units 110 unless they need to be distinguished from each other. In addition, in the above-described image forming apparatus 10, the attachment devices 500Y, 500M, 500C, and 500K have the same structure. Therefore, the attachment devices 500Y, 500M, 500C, and 500K will be generically referred to as attachment devices 500 unless they need to be distinguished from each other. In addition, in the above-described image forming apparatus 10, the transport devices 550Y, 550M, 550C, and 550K have the same structure. Therefore, the transport devices 550Y, 550M, 550C, and 550K will be generically referred to as transport devices 550 unless they need to be distinguished from each other.

Figure 2:
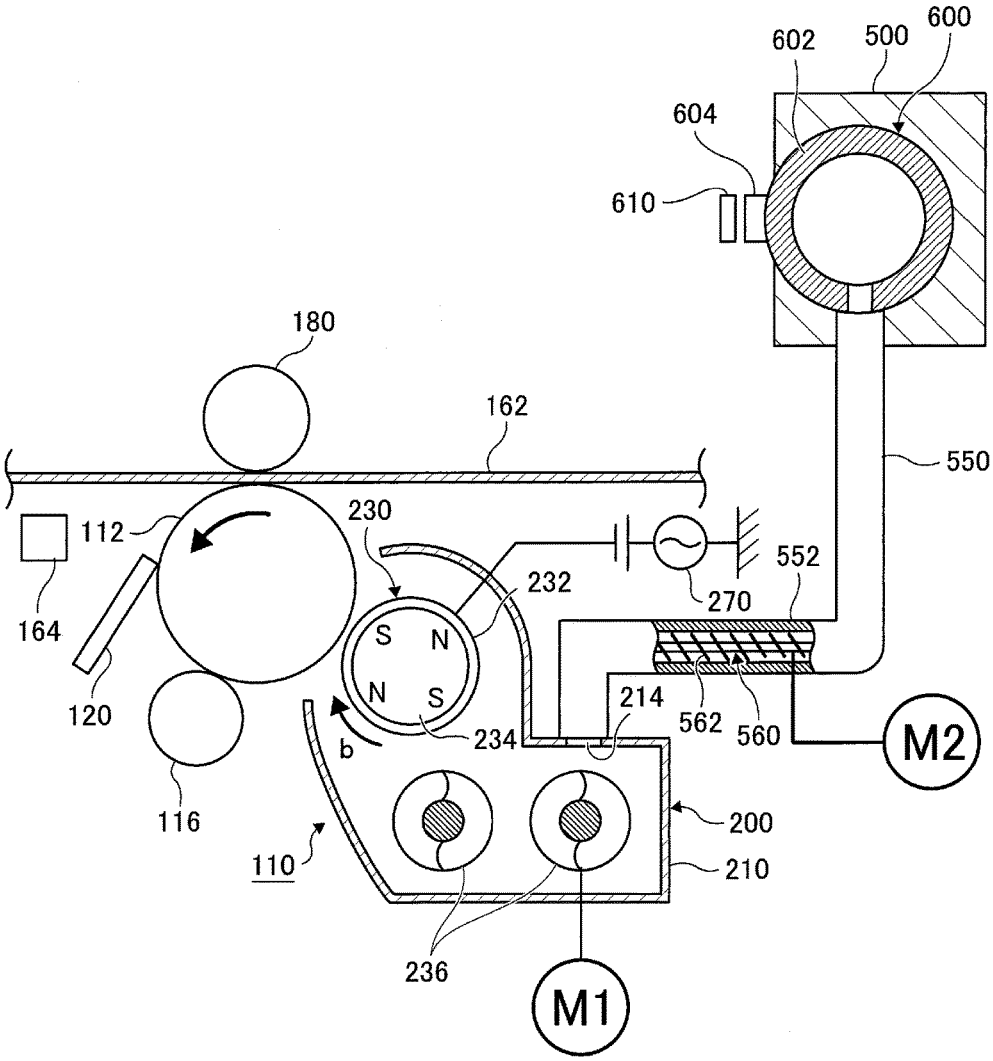
FIG. 2 is a sectional view illustrating an image forming unit according to the exemplary embodiment of the present invention.

FIG. 2 illustrates the detailed structure of each image forming unit 110. Referring to FIG. 2, the image forming unit 110 includes the above-described photoconductor drum 112, a charging device 116, the above-described developing device 200, and a cleaning device 120. The charging device 116 serves as a charging unit that charges the photoconductor drum 112, and uniformly charges the surface of the photoconductor drum 112. The cleaning device 120 cleans the photoconductor drum 112 by, for example, scraping off residual substances, such as the toner image, that remain on the surface of the photoconductor drum 112.

The developing device 200 is a so-called two-component developing device, and performs a developing process by using two-component developer, which is developer containing toner and carrier. The two-component developer used by the developing device 200 contains non-magnetic toner and magnetic carrier.

The developing device 200 includes a developing device body 210. The developing device body 210 has an opening 214. The toner transported from the container 600 by the transport device 550 is received through the opening 214.

A developing roller 230 is disposed in the developing device body 210. The developing roller 230 includes a developing sleeve 232, which is arranged so as to be in contact with or close to the photoconductor drum 112, and a magnet roller 234. The developing sleeve 232 is a hollow cylindrical member and serves as a toner holder that holds charged toner. The developing sleeve 232 supplies the toner to the photoconductor drum 112 when a developing bias is applied thereto.

A bias applying device 270, which applies the developing bias to the developing sleeve 232, is connected to the developing sleeve 232.

The magnet roller 234 is a solid cylindrical permanent magnet disposed in a hollow section of the developing sleeve 232, and plural S poles and plural N poles are appropriately arranged in the magnet roller 234. The magnet roller 234 generates a magnetic force that causes the carrier to adhere to the surface of the developing sleeve 232, so that a magnetic brush is formed on the surface of the developing sleeve 232.

Two stirring transport members 236, for example, are disposed in a lower section of the developing device body 210. The stirring transport members 236 stir and transport the developer so as to circulate the developer in the developing device body 210, and supplies the developer to the developing sleeve 232. The developing sleeve 232 and the stirring transport members 236 are connected to a drive source M1, such as a motor. The developing sleeve 232 is rotated in the direction of arrow b in FIG. 2 by a driving force transmitted from the drive source M1.

The transport device 550 includes a transport-path defining member 552 and a transporting member 560. The transport-path defining member 552 is, for example, a hollow pipe-shaped member, and a hollow section thereof serves as a toner transport path through which the toner is transported. The transporting member 560 is disposed in the hollow section of the transport-path defining member 552, and includes, for example, a helical blade member 562. The transporting member 560 is rotated by a driving force transmitted from a drive source M2, and thereby transports the toner toward the developing device 200.

As illustrated in FIG. 2, the container 600 includes a storage medium 604. The storage medium 604 is attached to an outer surface of a container body 602 of the container 600. The storage medium 604 stores information regarding the toner contained in the container 600. The information regarding the toner includes, for example, the type and characteristics of the contained toner. The characteristics of the toner include, for example, the amount of colorant contained in the toner relative to the amount of base material of the toner.

As illustrated in FIG. 2, the image forming apparatus 10 further includes a reading device 610. The reading device 610 reads the information regarding the toner stored in the storage medium 604. The reading device 610 and the storage medium 604 communicate through, for example, wireless communication.

As illustrated in FIG. 2, a density detector 164 is arranged so as to face the intermediate transfer body 162. The density detector 164 includes, for example, a light emitting element and a light receiving element, and detects the density of an image transferred to the intermediate transfer body 162 by emitting light from the light emitting element and receiving the light reflected by the image with the light receiving element. The image whose density is detected by the density detector 164 includes a toner band and a density patch used to adjust the image density.

In the exemplary embodiment, the density detector 164 detects the density of the image transferred to the intermediate transfer body 162. However, the density detector 164 may instead detect the density of the image formed on the photoconductor drum 112, or the density of the image transferred to the recording medium.

Figure 3:
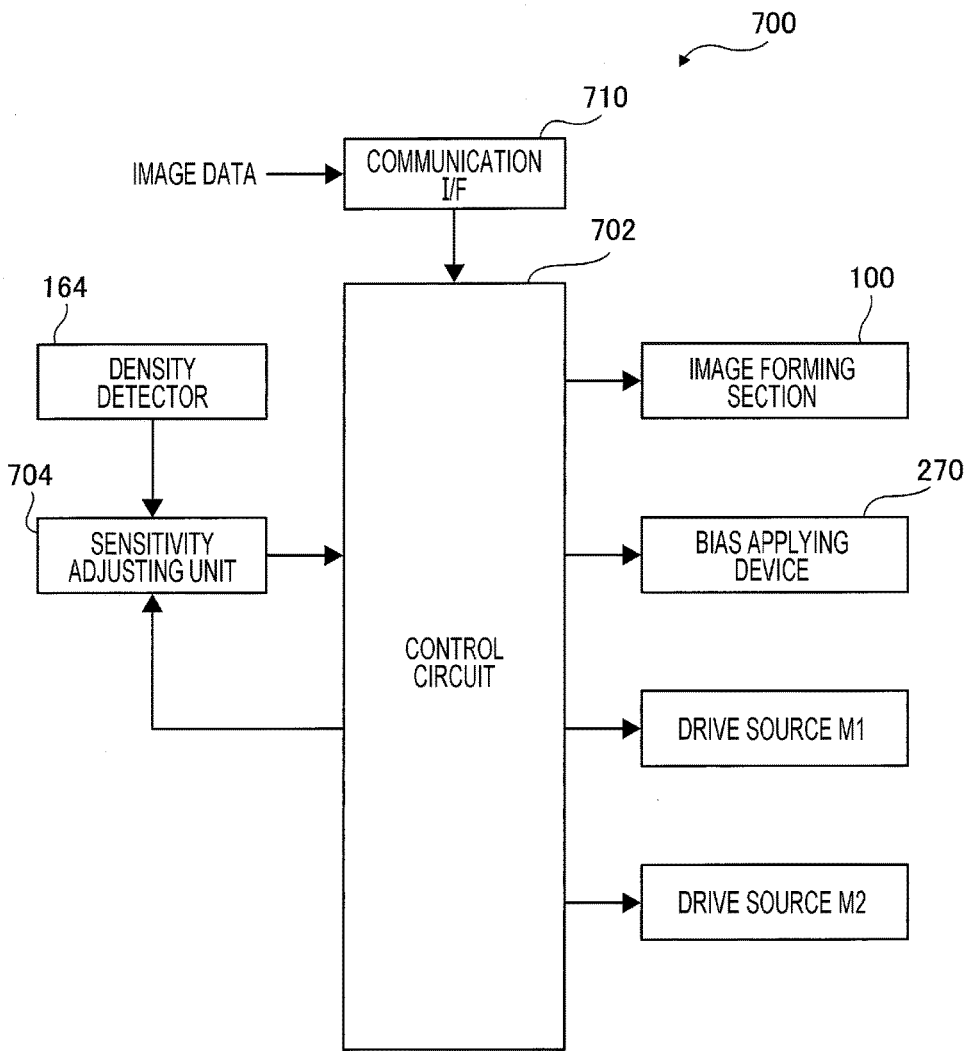
FIG. 3 is a circuit diagram of a controller included in the image forming apparatus according to the exemplary embodiment of the present invention.

FIG. 3 illustrates an example of a controller 700. The controller 700 includes a control circuit 702 composed of, for example, a computer. The control circuit 702 receives image data through a communication interface 710, and forms an image by controlling the image forming section 100 based on the image data. The control circuit 702 stores data used to form a toner band and a density patch, and forms the toner band and the density patch by controlling the image forming section 100.

The density data obtained by the density detector 164 is input to the control circuit 702 through a sensitivity adjusting unit 704. The control circuit 702 outputs a control signal to the bias applying device 270 to control the bias voltage applied by the bias applying device 270. The control circuit 702 may also adjust the amount of exposure of the optical writing device 190 included in the image forming section 100 and the density of the input image data.

The control circuit 702 also controls the operations of the drive source M1 for the developing device 200 and the drive source M2 for the transporting member 560.

Figure 4:
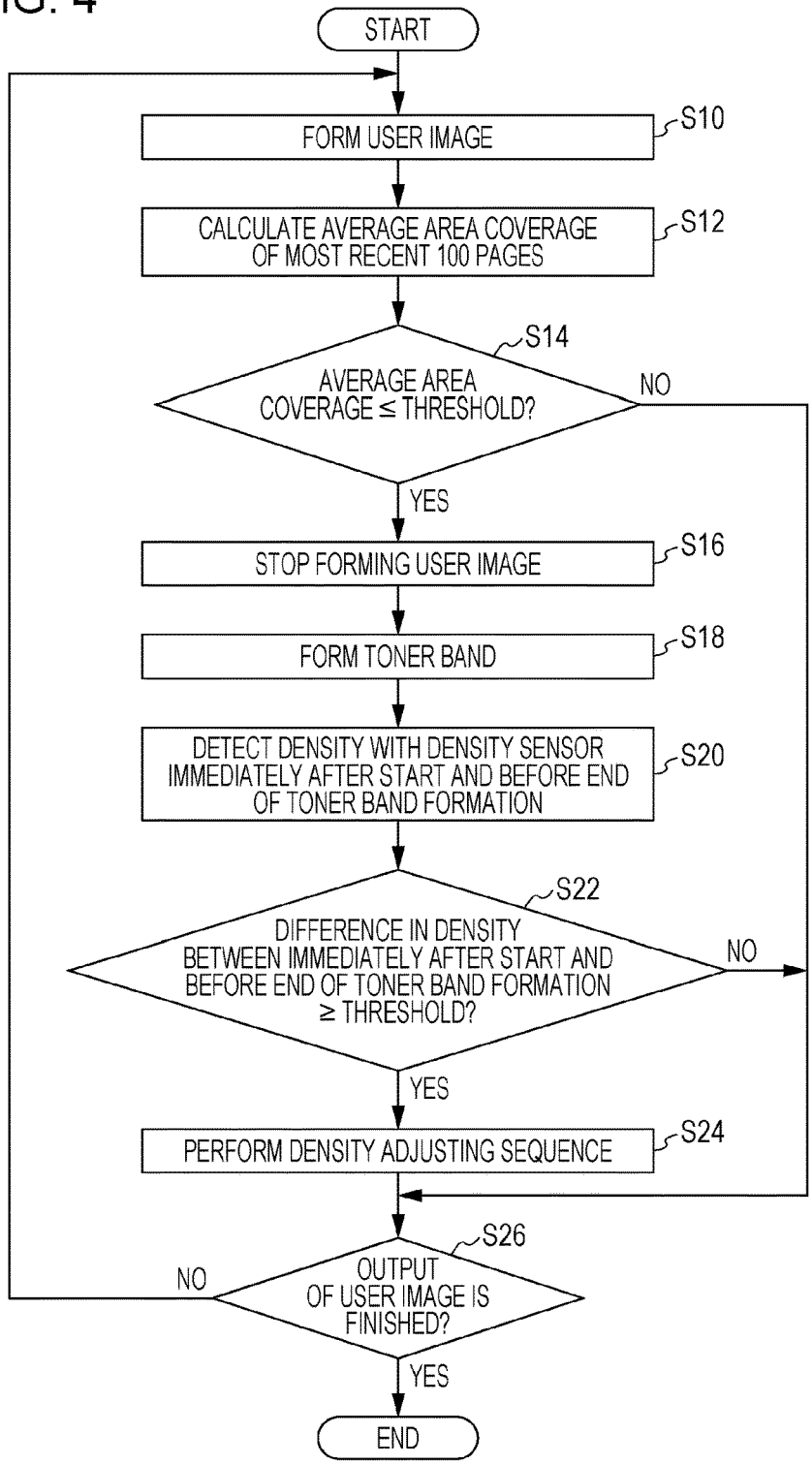
FIG. 4 is a flowchart of a control flow according to the exemplary embodiment of the present invention.

FIG. 4 is a flowchart of a program executed by the control circuit 702.

In step S10, a user image is formed. The user image is an image formed on the basis of an instruction from a user. For example, a toner image is formed by controlling the image forming section 100 based on the image data received from a computer of the user through the communication interface 710. The toner image is transferred onto a recording medium, and is fixed to the recording medium by the fixing device 150.

Next, in step S12, the average area coverage for the most recent 100 pages is calculated for each color. The average area coverage shows the amount of toner used per A4 page. The average area coverage may be, for example, an integrated value of the image density of the formed image with respect to the driving time of the drive source M1 for the developing device 200 during the processing period of the most recent 100 pages of A4 paper. Alternatively, the average area coverage may be the driving time of the drive source M2 for the transporting member 560, which transports the toner, with respect to the driving time of the drive source M1 for the developing device 200 during the processing period of the most recent 100 pages of A4 paper.

Next, in step S14, the average area coverage determined in step S12 is compared with a threshold (predetermined value), and it is determined whether or not the average area coverage is less than or equal to the threshold. For example, it is determined whether or not the average area coverage for each of the 100 pages of A4 paper is less than or equal to 4%.

When it is determined that the average area coverage is less than or equal to the threshold in step S14, the process proceeds to step S16. In step S16, the operation of forming the user image is stopped (or the process waits for the operation of forming the user image to end). Then, in step S18, a toner band is formed.

The toner band is a toner image that is different from the user image and that is formed on the image carrier to discharge the developer that is considered as degraded to the outside of the developing device 200 (toner image formed by using the toner contained in the developer that is considered as degraded). The density of the latent image that is formed on the surface of the photoconductor drum 112 and based on which the toner band is formed (input image density) may be substantially constant in a process direction (direction in which the toner band is formed on the image carrier).

When the difference between the threshold used in step S14 and the average area coverage is large, it is determined that the developer is severely degraded. In such a case, the toner band may be formed over an area greater than the area over which the toner band is formed when the difference is small. For example, the length of the toner band may be increased in the process direction or the direction perpendicular to the process direction. Thus, when the developer is severely degraded, the developer is more quickly refreshed by discharging a larger amount of toner from the developing device and supplying a larger amount of new toner into the developing device.

Alternatively, when the difference between the threshold and the average area coverage is large in step S14, the input image density may be set to a value greater than that in the case where the difference is small.

When developers of multiple colors are considered as degraded, the toner band may be formed by applying the developers of multiple colors to the image carrier in a superposed manner.

In the case where two-component developer is used, when the amount of toner that is consumed is small relative to the driving time of the developing device, an image defect may occur due to degradation of the developer (increase in toner charge) caused by embedding of external additives of the toner in the carrier. To avoid this, the toner band is formed in the above-described step S16 to replace the toner by discharging old toner and supplying new toner.

The image formed on the image carrier is required to have a predetermined (desired) density after the replacement of the toner. However, it is not always necessary to perform an image-density adjusting step (density adjusting sequence), that is, to perform a density adjustment, after the toner band is formed. Although the density adjusting sequence needs to be performed if the toner density changes due to the formation of the toner band, it is not necessary to perform the density adjusting sequence if the toner density does not change due to the formation of the toner. Accordingly, in the present exemplary embodiment, it is determined whether or not the density adjusting sequence is necessary by using the toner band.

In step S20, the density of the toner band is detected. The density of the toner band is detected on the basis of the signal from the above-described density detector 164. The density of the toner band is detected immediately after the start of the formation of the toner band and immediately before the end of the formation of the toner band.

In the case where the toner band is formed by applying developers of multiple colors in a superposed manner, the sensitivity adjusting unit 704 may reduce the amount of light emitted from the light emitting element of the density detector 164 or reduce the sensitivity of the light receiving element of the density detector 164 from those in the case where the toner band is formed by using a developer of a single color. In other words, a density detection method different from that in the case where the toner band is formed by using a developer of a single color may be used. This is because when developers of multiple colors are used, the density of the toner band is higher than that in the case where a developer of a single color is used, and the density easily exceeds the measurement limit of the density detector 164.

In step S22, it is determined whether or not the difference in density between a region formed immediately after the start of the formation of the toner band and a region formed immediately before the end of the formation of the toner band is greater than or equal to a threshold.

Figure 5:
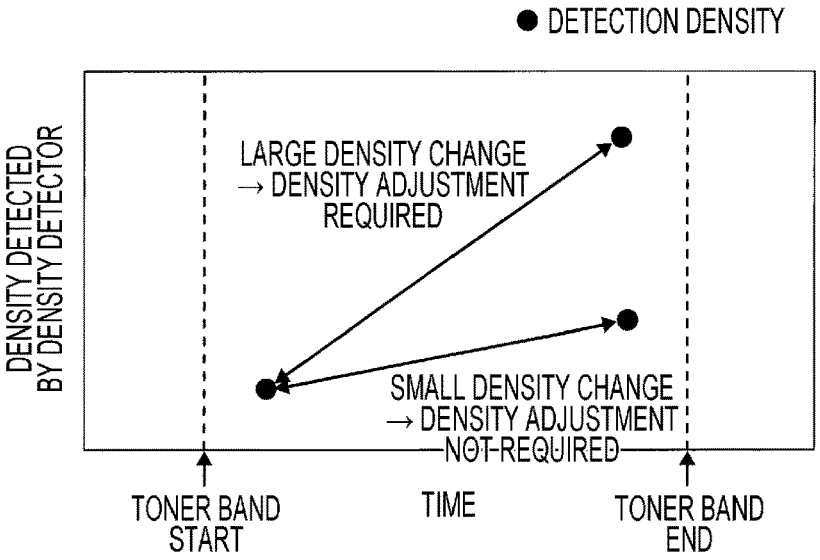
FIG. 5 is a diagram illustrating a first example of a method for evaluating a change in the density of a toner band according to the exemplary embodiment of the present invention.

More specifically, as illustrated in FIG. 5, the density detected by the density detector 164 in the region formed immediately after the start of the formation of the toner band is compared with the density detected by the density detector 164 in the region formed immediately before the end of the formation of the toner band. When the change in the density is greater than or equal to the threshold, the process proceeds to step S24, and the density adjusting sequence is performed.

When the change in the density is smaller than the threshold, the process proceeds to step S26 without performing the density adjusting sequence in step S24.

Instead of determining whether or not the change in the density in the process direction of the toner band is greater than or equal to the threshold, it may be determined whether or not the density in the region formed immediately before the end of the formation of the toner band is within a predetermined range. More specifically, the density adjusting sequence may not be performed when the density in the region formed immediately before the end of the formation of the toner band is within the predetermined range, and the density adjusting sequence may be performed otherwise. The region formed immediately before the end of the formation of the toner band is a region such that if the density in this region is within the predetermined range, the density of the toner image formed on the image carrier immediately after the end of the formation of the toner band will also be within the predetermined range.

Figure 6:
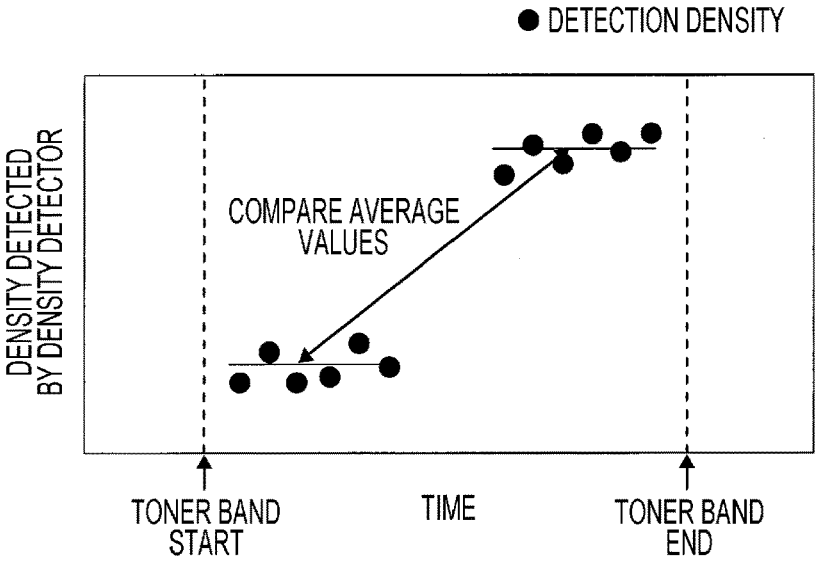
FIG. 6 is a diagram illustrating a second example of a method for evaluating a change in the density of a toner band according to the exemplary embodiment of the present invention.

As illustrated in FIG. 6, the average density of the toner band may be determined. In this case, the density detector 164 detects the density multiple times immediately after the start of the formation of the toner band, and determines the average of the detected densities. The density detector 164 also detects the density multiple times immediately before the end of the formation of the toner band, and determines the average of the detected densities. The average densities are compared, and when the difference between the average densities is greater than or equal to a threshold, the process proceeds to step S22 and the density adjusting sequence is performed. When the difference between the average densities is less than the threshold, the process proceeds to step S26 without performing the density adjusting sequence in step S24.

The threshold used in step S22 is changed depending on the pixel density of the toner band.

As commonly known, in the density adjusting sequence performed in step S24, a density patch is formed on the image carrier (photoconductor drum or intermediate transfer body) under fixed image forming conditions, and is detected by the density detector 164. The image forming conditions (for example, the photoconductor drum charge potential, the developing bias potential, the amount of exposure light, and the image signal) are changed depending on the result of the detection so that a desired density may be obtained.

In step S26, it is determined whether or not the output of the user image is finished. When it is determined that the output of the user image is not finished, the process returns to step S10. When it is determined that the output of the user image output is finished, the process ends.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a developing device that performs a developing process by using two-component developer;

an image carrier that carries a toner image including a toner band developed by the developing device;

a density detector that detects a density of the toner band; and a controller that determines whether or not to perform a density adjustment on the basis of an amount of change in the density detected by the density detector at least at one upstream position and at least at one downstream position in a process direction of the toner band.

2. The image forming apparatus according to claim 1, wherein the controller determines whether or not to perform the density adjustment on the basis of the amount of change in the density detected at a plurality of upstream positions and a plurality of downstream positions in the process direction of the toner band.

3. The image forming apparatus according to claim 1, wherein the controller determines to perform the density adjustment when the amount of change in the density in the process direction of the toner band is greater than or equal to a predetermined value.

4. The image forming apparatus according to claim 2, wherein the controller determines to perform the density adjustment when the amount of change in the density in the process direction of the toner band is greater than or equal to a predetermined value.

5. The image forming apparatus according to claim 1, wherein the controller determines not to perform the density adjustment when the amount of change in the density in the process direction of the toner band is smaller than a predetermined value.

6. The image forming apparatus according to claim 2, wherein the controller determines not to perform the density adjustment when the amount of change in the density in the process direction of the toner band is smaller than a predetermined value.

7. The image forming apparatus according to claim 1, wherein the developing device is one of a plurality of developing devices included in the image forming apparatus, and wherein, when the toner band is formed by the plurality of the developing devices, the density detector detects the density by a detection method different from a detection method used when the toner band is formed by only one of the developing devices.

8. A non-transitory computer readable medium storing a program causing a computer to execute a process comprising:

detecting a density of a toner band formed on an image carrier; and determining whether or not to perform a density adjustment on the basis of an amount of change in the density detected at least at one upstream position and at least at one downstream position in a process direction of the toner band.

9. An image forming apparatus comprising:

a developing device that performs a developing process by using two-component developer;

an image carrier that carries a toner image including a toner band developed by the developing device;

a density detector that detects a density of the toner band; and a controller that determines whether or not to perform a density adjustment on the basis of the density of the toner band detected by the density detector, wherein a density patch is not formed during a formation of the toner band.

10. The image forming apparatus according to claim 9, wherein the density adjustment is to form the density patch on the image carrier and to change an image forming condition depending on the density patch that is formed on the basis of the density of the toner band detected by the density detector.

11. The image forming apparatus according to claim 9, wherein the formation of the toner band is performed when the two-component developer is determined to be degraded.

* * * * *